US010407872B2

(12) United States Patent
Wei et al.

(10) Patent No.: US 10,407,872 B2
(45) Date of Patent: Sep. 10, 2019

(54) SYSTEM AND METHOD FOR CONTROLLING EARTHMOVING MACHINES

(71) Applicant: Caterpillar Inc., Peoria, IL (US)

(72) Inventors: Mo Wei, Dunlap, IL (US); Mikael Holmqvist, Brisbane (AU); Michael A. Taylor, Wexford, PA (US); Kyle A. Edwards, Sahuarita, AZ (US); Brian G. Funke, Peoria, IL (US); Seth J. Redenbo, Maple Grove, MN (US)

(73) Assignee: Caterpillar Inc., Deerfield, IL (US)

( * ) Notice: Subject to any disclaimer, the term of this patent is extended or adjusted under 35 U.S.C. 154(b) by 59 days.

(21) Appl. No.: 15/677,113

(22) Filed: Aug. 15, 2017

(65) Prior Publication Data

US 2019/0055715 A1 Feb. 21, 2019

(51) Int. Cl.

| | |
|---|---|
| ***E02F 9/20*** | (2006.01) |
| ***E02F 3/84*** | (2006.01) |
| ***E02F 3/76*** | (2006.01) |
| ***E02F 9/26*** | (2006.01) |

(52) U.S. Cl.

CPC ..... *E02F 9/205* (2013.01); *E02F 3/7604* (2013.01); *E02F 3/841* (2013.01); *E02F 9/262* (2013.01); *E02F 9/265* (2013.01)

(58) Field of Classification Search

CPC ..... E02F 3/7604; E02F 3/841; E02F 9/205; E02F 9/262

USPC ..... 701/24

See application file for complete search history.

(56) References Cited

U.S. PATENT DOCUMENTS

| | | | | |
|---|---|---|---|---|
| 9,256,227 | B1 * | 2/2016 | Wei | G05B 15/02 |
| 9,388,550 | B2 * | 7/2016 | Wei | E02F 9/2029 |
| 9,469,967 | B2 * | 10/2016 | Edara | E02F 9/2029 |
| 9,605,415 | B2 * | 3/2017 | Edara | G01M 99/005 |
| 9,663,921 | B2 * | 5/2017 | Wei | E02F 9/2041 |
| 9,760,081 | B2 * | 9/2017 | Taylor | E01C 19/004 |
| 2012/0136525 | A1 * | 5/2012 | Everett | E02F 9/2045 701/24 |
| 2012/0174445 | A1 * | 7/2012 | Jones | A01B 69/007 37/197 |
| 2013/0231823 | A1 * | 9/2013 | Wang | A01B 69/008 701/24 |
| 2014/0297091 | A1 * | 10/2014 | Itoi | E02F 9/2054 701/24 |

(Continued)

*Primary Examiner* — Atul Trivedi

(74) *Attorney, Agent, or Firm* — L. Glenn Waterfield

(57) ABSTRACT

A control system for controlling an earthmoving machine operating at a worksite is disclosed. The control system includes a receiving unit to receive a first input indicative of a terrain profile of the worksite, a second input indicative of a target terrain profile for the worksite, and a third input indicative of machine characteristics. The control system also includes a mission planning controller to generate an excavation plan based on the first input, the second input, and the third input. The controller controls operation of the machine, based on the generated excavation plan, to obtain an excavated terrain profile. Further, the controller determines whether the excavated terrain profile matches with the target terrain profile, and operates the machine based on inputs indicative of the excavated terrain profile, the second input, the third input, and an extent of match between the excavated terrain profile and the target terrain profile.

20 Claims, 8 Drawing Sheets

(56) References Cited

U.S. PATENT DOCUMENTS

| | | | | |
|---|---|---|---|---|
| 2015/0134184 | A1* | 5/2015 | Takeda | G05D 1/0278 701/24 |
| 2017/0041407 | A1* | 2/2017 | Wilbur | H04L 67/18 |
| 2018/0335784 | A1* | 11/2018 | Wei | E02F 9/261 |

* cited by examiner

SYSTEM AND METHOD FOR CONTROLLING EARTHMOVING MACHINES

TECHNICAL FIELD

The current disclosure relates to systems for controlling machines operating at a worksite and, more particularly, relates to a control system and a method for controlling an earthmoving machine operating at the worksite.

BACKGROUND

Worksites, such as mine sites, landfills, and construction sites, undergo topographical transformation by machines and/or workers performing various tasks thereat. Machines, such as dozers, excavators, motor graders, and wheel loaders, are deployed at the worksite to perform a mission. The mission can include digging, grading, and leveling, for altering a terrain at the worksite, based on an excavation plan.

The machines can be operated autonomously or semi-autonomously to execute the mission. While operating in the autonomous or the semi-autonomous manner, it is desired to minimize or eliminate need of an operator's intervention. Commands generated for moving the machines and their associated work implements are often generated by a planning system. However, multiple parameters are required to be considered and/or set prior to creation and implementation of such excavation plans, which otherwise may affect command generation and impact operation efficiency of the machines. A small error during consideration of the parameters may render the excavation plan invalid or unacceptable and may impact overall efficiency of the machines.

SUMMARY OF THE DISCLOSURE

In one aspect of the current disclosure, a control system for controlling an earthmoving machine operating at a worksite is provided. The control system includes a receiving unit configured to receive a first input indicative of a terrain profile of the worksite, a second input indicative of a target terrain profile for the worksite, and a third input indicative of characteristics of the earthmoving machine. The control system further includes a mission planning controller in communication with the receiving unit. The mission planning controller is configured to generate an excavation plan based on the first input, the second input, and the third input. The mission planning controller is further configured to control operation of the earthmoving machine, based on the generated excavation plan, to obtain an excavated terrain profile. The mission planning controller is further configured to determine whether the excavated terrain profile matches with the target terrain profile, and operate the earthmoving machine, based on inputs indicative of the excavated terrain profile, the second input, the third input, and an extent of match between the excavated terrain profile and the target terrain profile.

In another aspect of the current disclosure, a method for controlling an earthmoving machine operating at a worksite is provided. The method includes receiving a first input indicative of a terrain profile of the worksite, receiving a second input indicative of a target terrain profile for the worksite, and receiving a third input indicative of characteristics of the earthmoving machine. The method further includes generating an excavation plan based on the first input, the second input, and the third input. The method further includes controlling operation of the earthmoving machine, based on the generated excavation plan, to obtain an excavated terrain profile. The method further includes determining whether the excavated terrain profile matches with the target terrain profile, and operating the earthmoving machine, based on inputs indicative of the excavated terrain profile, the second input, the third input, and an extent of match between the excavated terrain profile and the target terrain profile.

In yet another aspect of the current disclosure, an earthmoving machine is provided. The earthmoving machine includes a work implement for engaging ground surface of a worksite and a control system for operating the earthmoving machine. The control system includes a mission planning controller configured to receive a first input indicative of a terrain profile of the worksite, a second input indicative of a target terrain profile for the worksite, and a third input indicative of characteristics of the earthmoving machine. The mission planning controller is further configured to generate an excavation plan based on the first input, the second input, and the third input. The mission planning controller is further configured to adjust the work implement, based on the generated excavation plan, to obtain an excavated terrain profile. The mission planning controller is further configured to determine whether the excavated terrain profile matches with the target terrain profile, and operate the earthmoving machine, based on inputs indicative of the excavated terrain profile, the second input, the third input, and an extent of match between the excavated terrain profile and the target terrain profile.

Other features and aspects of this disclosure will be apparent from the following description and the accompanying drawings.

DETAILED DESCRIPTION

Figure 1:
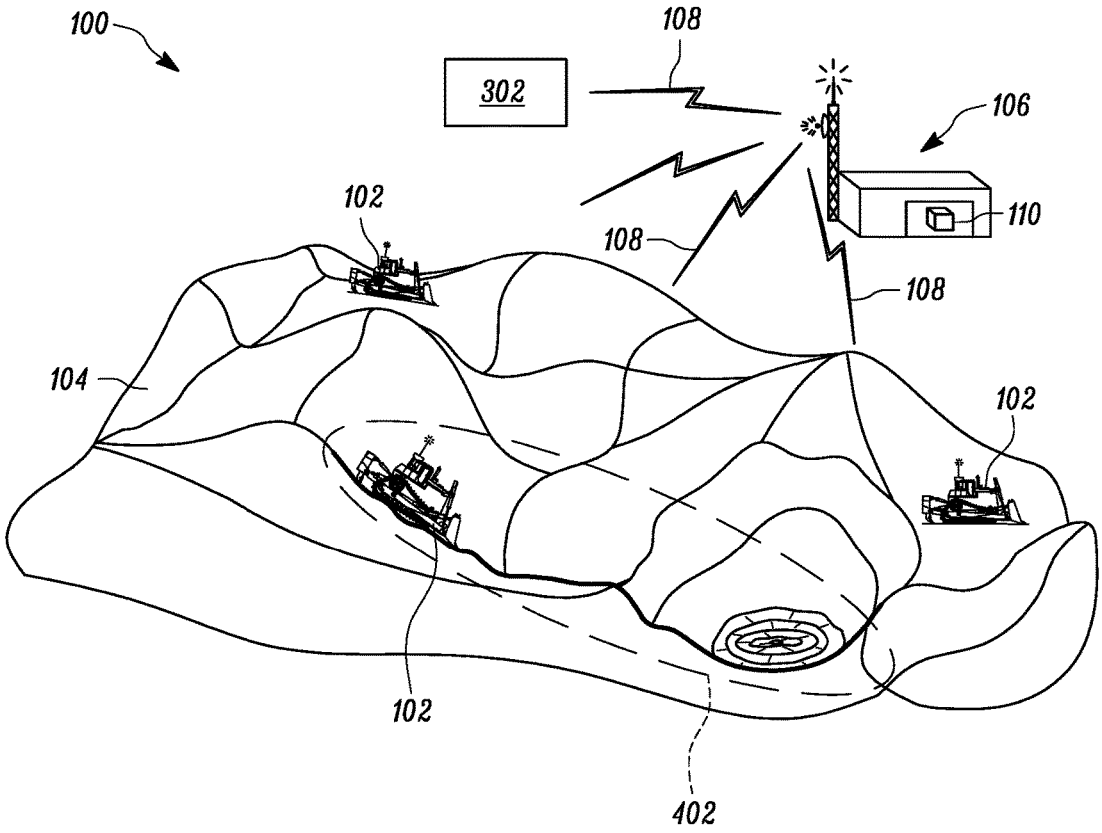
FIG. 1 is a diagrammatic view showing a worksite and multiple earthmoving machines operating at the worksite, according to an aspect of the current disclosure.

FIG. 1 illustrates a diagram of a worksite 100 and multiple earthmoving machines, hereinafter referred to as the machine(s) 102, performing predetermined tasks at the worksite 100, according to an exemplary embodiment of the current disclosure. The worksite 100 may include terrain surfaces having multiple elevation, slopes, voids or pits. The machine(s) 102 may be operated at the worksite 100 for performing various predetermined tasks for altering a terrain profile 104 at the worksite 100. The predetermined tasks may include, but not limited to, a dozing operation, a grading operation, a leveling operation, or any other type of operation to alter the terrain profile 104 at the worksite 100. The predetermined tasks are performed by the machines 102 based on instruction(s) communicated by an operator (not shown) located at the worksite 100 or at an operator station 106.

The operator station 106 may be located proximal to the worksite 100 or may be located remotely from the worksite 100. The operator station 106 may include data repository (not shown) having details including, but not limited to, terrain information of the worksite 100, number of active machines at the worksite 100, characteristics of the machines 102. The operator station 106 may further be equipped with multiple devices capable of receiving data, processing the data, and communicating the processed data via communication channels 108 to the machines 102.

The operator station 106 further includes a control system 110, hereinafter referred to as the system 110. The system 110 is configured to be in communication with the multiple devices located at the operator station 106, the machines 102 located at the worksite 100, and a perception unit 302. The system 110 is configured to control operation of the machines 102 based on the processed data from the multiple devices, and inputs received from the operator and the perception unit 302.

The perception unit 302 is configured to capture the terrain profile 104 of the worksite 100. The terrain profile 104 may include terrain data, such as elevation, material type, material properties, slip coefficient, and other data of the terrain profile 104. In an example, the perception unit 302 may be embodied as an aerial unit, such as a drone, to perform an automated survey of the worksite 100. For such purpose, the perception unit 302 may be equipped with survey systems, such as stereo photography cameras, or LASER, or RADAR, to capture the terrain profile 104 of the worksite 100. It may be understood here that the perception unit 302 captures the terrain profile 104 through stereo photos or through multiple frames which may constitute a video as well. Since the perception unit 302 can be embodied as devices capable of being disposed aerially above the worksite 100, the perception unit 302 is illustrated outside the operator station 106. In another example, the perception unit 302 may either be mounted on the operator station 106 or at an appropriate location in the worksite 100, where the perception unit 302 is capable of capturing the terrain profile 104 of the worksite 100 from a distance.

Figure 2:
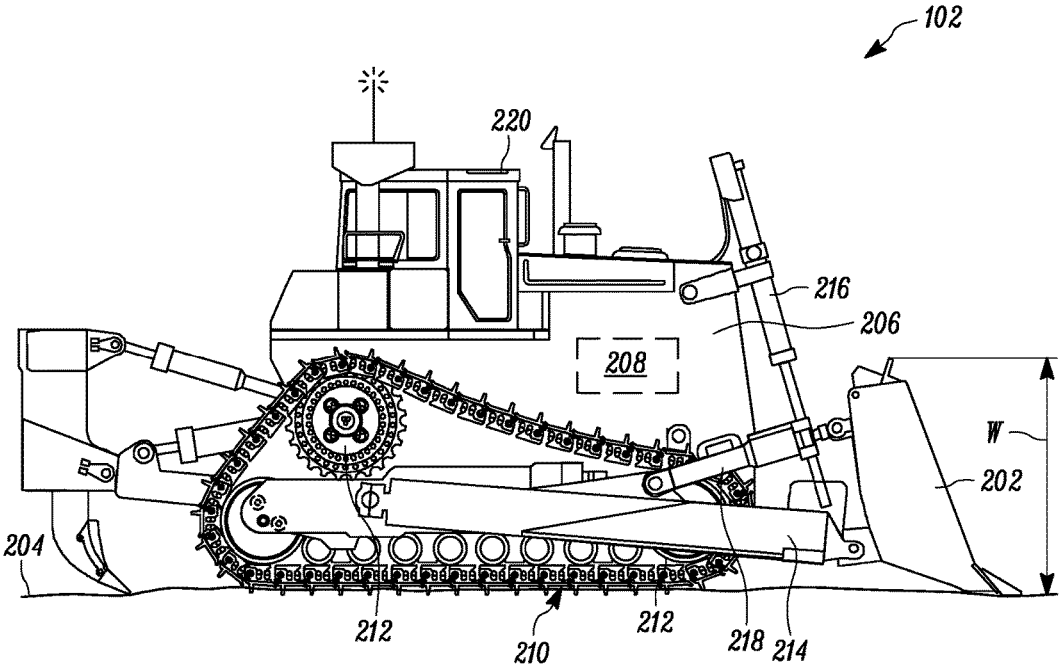
FIG. 2 is a schematic side view of an earthmoving machine, according to an aspect of the current disclosure.

FIG. 2 illustrates a side view of one of the machine 102 illustrated in FIG. 1. The machine 102 is a dozer, equipped with a work implement 202, such as a blade, for engaging a ground surface 204 at the worksite 100 and pushing material from one location to the other location. The machine 102 also includes a frame 206 and an engine 208 supported on the frame 206. Ground-engaging members, such as tracks 210, are provided on the frame 206 to propel the machine 102. The engine 208 and a transmission (not shown) are operatively connected to drive sprockets 212, which in turn drive the tracks 210. The work implement 202 may be pivotably connected to the frame 206 by arms 214. The machine 102 also includes a first hydraulic cylinder 216 coupled to the frame 206, which supports the work implement 202 and allows the work implement 202 to move up and down. Further, a second hydraulic cylinder 218 allows angular movement of lower tip of the work implement 202 with respect to the arms 214.

The machine 102 further includes a cab 220 having multiple input devices (not shown). The multiple input devices are configured to receive operational commands from either the operator station 106 or a remote control device (not shown), to control operation of the machine 102 and operate the work implement 202 of the machine 102. The machine 102 can be operated either autonomously or semi-autonomously. When the machine is operated in semi-autonomous manner, the machine 102 can be controlled by the remote control device present at the operator station 106 or by an operator using the remote control device at the worksite 100. When operating autonomously, operational commands are communicated to the machine 102 from the operator station 106 or from the remote control device (not shown) through wireless communication. On receipt of such operational commands, the machine 102 executes operations based on the received operational commands.

Figure 3:
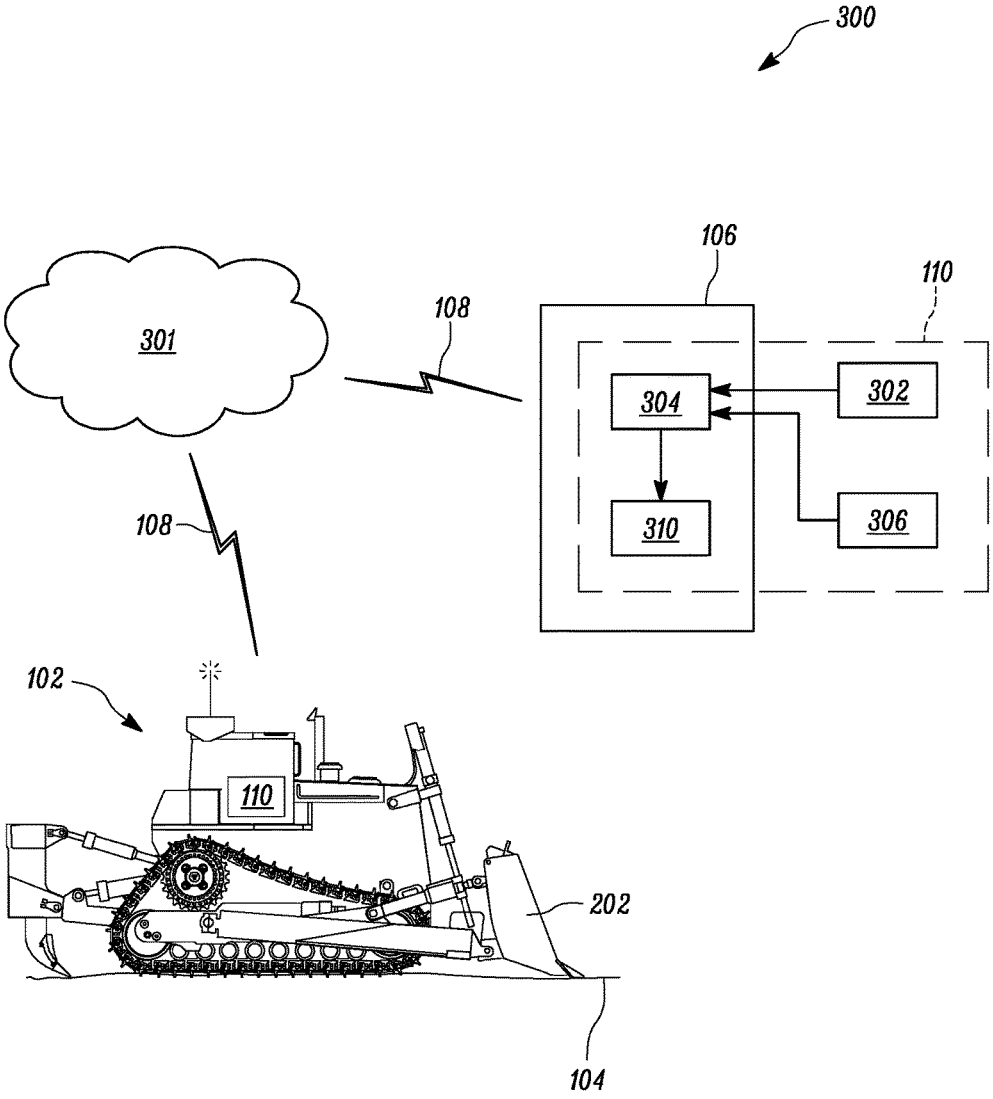
FIG. 3 is a schematic block diagram of a control system for controlling the earthmoving machine, according to an aspect of the current disclosure.

FIG. 3 illustrates a schematic diagram of a network environment 300 implementing the system 110 to control the operation of the machine 102, according to an aspect of the current disclosure. Although FIG. 3 illustrates one machine 102, it should not be considered to limit the scope of the current disclosure. It should be understood that the system 110 may be configured to control multiple machines 102 simultaneously operating at the worksite 100. The network environment 300 includes the machine 102 operating at the worksite 100, the operator station 106, and a network 301 to establish communication between the machine 102, the operator station 106 and the system 110.

The perception unit 302 is configured to be in communication with a receiving unit 304 and capture the terrain profile 104 of the worksite 100. Upon capturing the terrain profile 104, the perception unit 302 is configured to generate a first input 'I-1'.

The receiving unit 304 in communication with the perception unit 302 is configured to receive a first input 'I-1' indicative of the terrain profile 104 of the worksite 100. In one embodiment, the communication between the perception unit 302 and the receiving unit 304 may be established through the network 301. In another embodiment, a separate communication channel may be provided for the communication between the perception unit 302 and the receiving unit 304. The receiving unit 304 is further configured to be in communication with a user interface 306 of the system 110.

In one embodiment, the user interface 306 may include devices, including but not limited to, a computer device having a display. The user interface 306 enables a user or the operator to feed a target terrain profile (indicated by reference numeral 408 in FIG. 4) for the worksite 100. The phrase 'target terrain profile' may be understood as a final terrain of the worksite 100 desired by the operator or a customer. In another embodiment, data pertaining to the target terrain profile may be communicated to the system 110 through Internet or applications in operator's personalized devices. For example, the user interface 306 may include ports (not shown) to connect external storage devices (not shown) to feed the target terrain profile. In yet another embodiment, the user interface 306 may be capable of allowing the operator or the customer to create the target terrain profile at the operator station 106.

The target terrain profile may be designed based on a requirement by the operator and/or the customer. Additionally, the target terrain profile may be designed based on a current terrain at the worksite 100. Factors such as type of constituent material and distribution of the constituent material in the worksite 100 may also be considered while designing the target terrain profile. For the purpose of this description, data pertaining to the target terrain profile is considered as a second input 'I-2'. Accordingly, the receiving unit 304 is configured to receive the second input 'I-2' indicative of the target terrain profile. The receiving unit 304 of the system 110 is further configured to be in communication with the machine 110 operating at the worksite 100.

The system 110 is located in the operator station 106 and is configured to be in communication with the machine 102 through the network 301 and the communication channels 108, for controlling the operation of the machine 102. In an example, the network 301 may be a wireless network.

The receiving unit 304 is further configured to receive a third input 'I-3' indicative of characteristics of the machine 102. The characteristics of the machine 102 may be available at the data repository located at the operator station 106 or a central server (not shown) present at a remote location. The characteristics of the machine 102 may include, but not limited to, width 'W' (as shown in FIG. 2) of the work implement 202 of the machine 102, length of the work implement 202 of the machine 102, and width of the machine 102. The phrase 'width of the work implement 202' may be understood as a dimension of the work implement 202 along a vertical axis of the machine 100, as shown in FIG. 2, 'Length of the work implement 202' may be understood as a dimension of the work implement 202 measured in a direction perpendicular to the width 'W' of the work implement 202. In one example, data pertaining to the characteristics of the machine 102 may be received by the receiving unit 304 from the machine 102 via the communication channel 108 extending between the system 110 and the machine 102. In another example, such data may be fed by the operator on the user interface 306.

The system 110 further includes a mission planning controller 310, hereinafter referred to as the controller 310. The term "controller" is meant to be used in its broadest sense to include one or more controllers and/or microprocessors that may be associated with the machine 102 and that may cooperate in controlling various functions and operations of the machine 102.

In some examples, the controller 310 may be a processor that may include a single processing unit or a number of processing units, all of which include multiple computing units. The explicit use of the term 'processor' should not be construed to refer to software and/or hardware capable of executing a software application. Rather, the controller 310 may be implemented as one or more microprocessors, microcomputers, digital signal processors, central processing units, state machine, logic circuitries, and/or any device capable of manipulating signals based on operational instructions. Among the capabilities mentioned herein, the controller 310 may also be configured to receive, transmit, and execute computer-readable instructions. For example, the controller 310 may operate in a logical fashion to perform desired operations, execute control algorithms, store and process images.

In some embodiments, the controller 310 may be embodied as non-transitory computer readable medium. In an example, the non-transitory computer readable medium may include a memory, such as RAM, ROM, a flash memory, and a hard drive, and/or a data repository integrated therein. The computer readable medium may also be configured to store electronic data associated with operation of the machine 102.

In the current disclosure, the controller 310 is communicatively coupled with the receiving unit 304 and is configured to generate an excavation plan (indicated by reference numeral 414 in FIG. 4 and FIG. 5) based on the first input 'I-1', the second input 'I-2', and the third input 'I-3'. The phrase 'excavation plan' may be understood as a set of operational steps designed for the purpose of operating the machine 102 to achieve the target terrain profile. The excavation plan may include one or more excavation paths for travel of the machine 102, and a cutting operation and a material moving operation associated with the excavation path. Besides the functionality of generating the excavation plan, the controller 310 is also configured to generate a first two-dimensional diagram (indicated by the reference numeral 404 in FIG. 4) based on the terrain profile 104 corresponding to the first input 'I-1', and also generate a second two-dimensional diagram (indicated by the reference numeral 406 in FIG. 4) based on the target terrain profile corresponding to the second input 'I-2'. Further, the controller 310 is also configured to generate a superimposed diagram (indicated by the reference numeral 410 in FIG. 4) based on the first two-dimensional diagram and the second two-dimensional diagram. Since the excavation plan is generated by the controller 310 based on the terrain profile 104 and the target terrain profile, the generated excavation plan may also be generated as a two-dimensional diagram. In one embodiment, the controller 310 may be configured to generated three-dimensional diagrams for the terrain profile 104, the target terrain profile, and the excavation plan.

Figure 5:
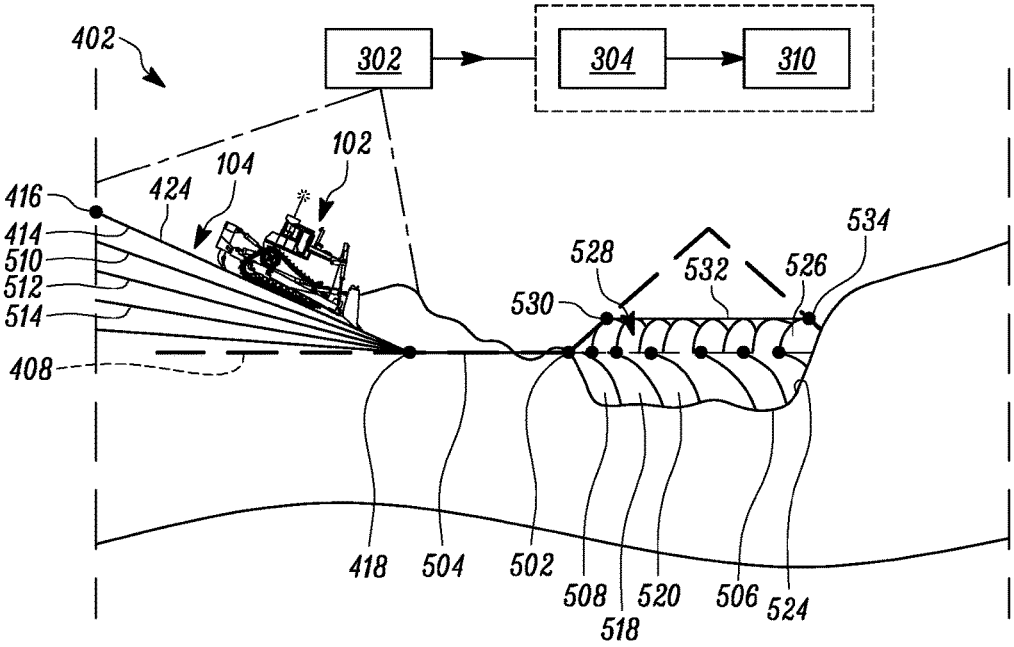
FIG. 5 is a schematic diagram of the exemplary portion of FIG. 4 showing operation of the earthmoving machine based on the excavation plan, according to an aspect of the current disclosure.

Based on the generated excavation plan, the controller 310 is configured to control operation of the machine 102 to obtain an excavated terrain profile (indicated by reference numeral 424 in FIG. 5). The machine 102 may be required to travel to-and-fro multiple times along the excavation path in order to achieve the target terrain profile. As such, multiple excavated terrain profiles may be obtained until the target terrain profile is achieved, where each excavated terrain profile corresponds to one excavation plan. In certain aspects of the current disclosure, a switch unit (not shown) may be provided at the operator station 106 to enable the operator to initiate generation of the excavation plans. Put it other way, the excavation plan may be automatically generated as soon as the operator operates the switch unit. Additionally, operation of the switch unit may also cause communication of the generated excavation plan to the machine 102. The excavation plan communicated to the machine 102 may also include the operational commands to control the operation of the machine 102 and execute the excavation plan. Therefore, the machine 102 of the current disclosure is autonomously operated.

Upon execution of each excavation plan, the perception unit 302 captures the excavated terrain profile and generates inputs indicative of the excavated terrain profile. Subsequently, the receiving unit 304 may receive real-time inputs, from the perception unit 302, indicative of the excavated terrain profile. Further, the controller 310 is configured to determine whether the excavated terrain profile matches with the target terrain profile. The manner in which the controller 310 compares the excavated terrain profile and the target terrain profile is described with respect to FIG. 4 and FIG. 5.

In cases where the controller 310 determines that the excavated terrain profile matches with the target terrain profile, the controller 310 may stop controlling the operation of the machine 102. In an example, the controller 310 may notify the operator that the target terrain profile is achieved. However, in cases where the controller 310 determines that the excavated terrain profile is not matching with the target terrain profile, the controller 310 is configured to generate additional excavation plans. The machine 102 may then be operated by the controller 310, to execute the additional excavation plans, based on inputs indicative of the excavated terrain profile, the second input 'I-2', the third input 'I-3', and an extent of match between the excavated terrain profile and the target terrain profile.

Figure 4:
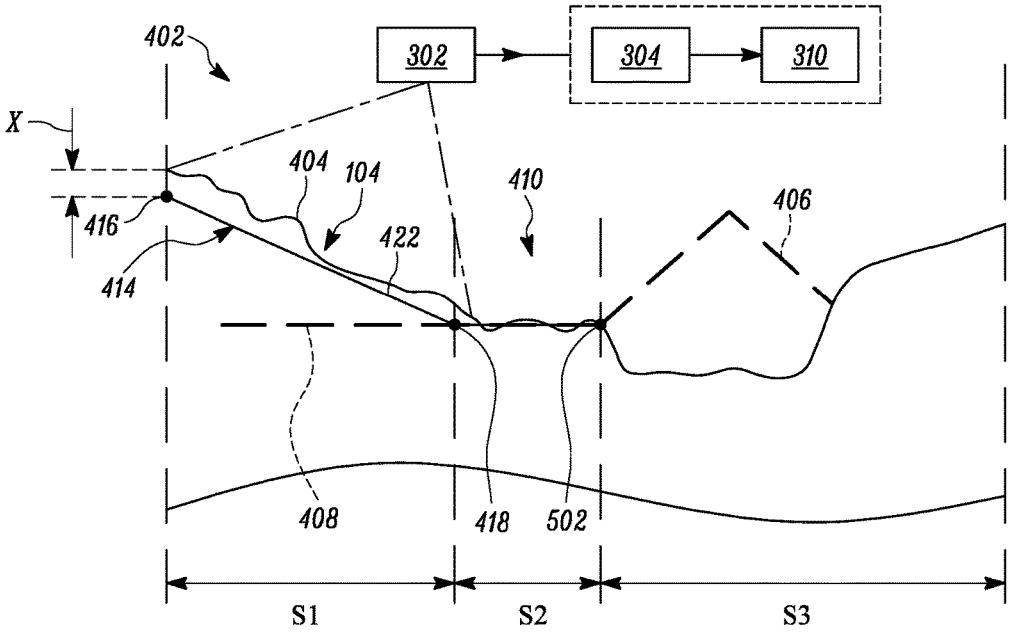
FIG. 4 is a schematic diagram of an exemplary portion of the worksite and an excavation plan generated for the exemplary portion, according to an aspect of the current disclosure.

FIG. 4 illustrates a schematic diagram of an exemplary portion 402 (also shown in FIG. 1) of the worksite 100 for which an excavation plan is required to be generated. The controller 310 generates the first two-dimensional diagram 404 of the terrain profile 104 and the second two-dimensional diagram 406 of the target terrain profile 408. In an embodiment, the controller 310 may be configured to gather captured images or captured frames of the terrain profile 104 from the perception unit 302, through the receiving unit 304, and generate the two-dimensional diagrams based on gathered data.

Further, the controller 310 generates the superimposed diagram 410 based on the first two-dimensional diagram 404 and the second two-dimensional diagram 406, as shown in FIG. 4. The superimposed diagram 410 may be displayed on the user interface 306, so that the operator at the operator station 106 is able to check correctness of the superimposed diagram 410, while also ensuring correctness of the second two-dimensional diagram 406. Any changes to the target terrain profile 408 or the superimposed diagram 410 may be implemented by the operator, through the user interface 306. The controller 310 may accordingly generate new diagrams and display the same on the user interface 306.

As described earlier, the controller 310 generates the excavation plan 414, based on the terrain profile 104, the target terrain profile 408, and the characteristics of the machine 102. The excavation plan 414 includes multiple nodes and multiple segments, where each segment connects two consecutive nodes and is indicative of an excavation path for the machine 102. Among the multiple nodes, a first node 416 is defined at a beginning of a predefined portion, such as the exemplary portion 402, of the worksite 100 and at the predetermined depth 'X' from the terrain profile 104, based on the characteristics of the machine 102 and the target terrain profile 408. A second node 418 of the multiple nodes is defined at a point of intersection of the target terrain profile 408 and a locus of the first node 416 tracing a path spaced apart at the predetermined depth 'X' along the terrain profile 104. In case the second node 418 cannot be defined based on the locus of the first node 416 mentioned hereinabove, the second node 418 is defined at a point of intersection of the target terrain profile 408 and an inclined line extending from the first node 416. The inclined line is associated with a predetermined slope. In an example, the predetermined slope for the inclined line may be determined based on the terrain profile 104. For instance, the predetermined slope may vary based on elevation of the terrain profile 104 with respect to a horizontal ground surface at the worksite 100. In an aspect of the current disclosure, minimum number of nodes in the excavation plan 414 may be two for the uneven surface. In case the terrain profile 104 includes elevations and pits, the number of nodes may increase to three or four based on complexity of the terrain profile 104 and the target terrain profile 408.

Generation of the excavation plan 414 with respect to FIG. 4, after the generation of the superimposed diagram 410, is described below. For the purpose of clarity in the description, the exemplary portion 402 of the worksite 100 is considered in three segments, namely a first segment 'S1', a second segment 'S2', and a third segment 'S3'. As can be seen from the FIG. 4, the first segment 'S1' includes an uneven inclined terrain, the second segment 'S2' includes an uneven horizontal terrain, and the third segment 'S3' includes a void or a pit.

Considering that the machine 102 will be deployed at the beginning of the exemplary portion 402 of the worksite 100, the controller 310 generates the excavation plan 414 based on the terrain of the three segments, the target terrain profile 408, and the characteristics of the machine 102. Based on the generated two-dimensional diagram of the terrain profile 104 in first segment 'S1', the first node 416 of the excavation plan 414 is defined at the beginning of the exemplary portion 402 and at the predetermined depth 'X' from the terrain profile 412. In an example, the predetermined depth 'X' from the terrain profile 412 may be set to at least 50 percent of the width 'W' of the work implement 202 of the machine 102. However, the predetermined depth 'X' may be selected from a range, for example, between 30 percent and 75 percent. The first node 416 is displayed on the superimposed diagram 410 already present on the user interface 306.

For the purpose of defining the second node 418 of the excavation plan 414, the controller 310 may plot a locus of the first node 416, such that the locus is spaced at a distance equal to the predetermined depth 'X' along the terrain profile 104. At a point where the locus intersects the target terrain profile 408, the second node 418 is defined. In cases where such locus condition does not yield an intersection point between the terrain profile 104 and the target terrain profile 408, the controller 310 may plot an inclined line extending from the first node 416 and intersecting the target terrain profile 408. The inclined line may be associated with a predetermined slope. In one example, the predetermined slope may be 20 percent. However, for some exemplary portions of the worksite 100 where the above two ways of defining the second node 418 does not hold good, the controller 310 may define the second node 418 at an end of such exemplary portion of the worksite 100. Further, the controller 310 plots a first line segment 422 between the first node 416 and the second node 418. The first line segment 422 indicates the excavation path for the machine 102 in the segment-1.

In order to have the excavation plan 414 executed by the machine 102, the controller 310 communicates operational commands to the machine 102 through the communication channel 108. For example, the controller 310 may communicate the operational commands to an electronic control module (ECM) of the machine 102. In one embodiment, the operational commands may include adjusting penetration of the work implement 202 into the terrain profile 104 at the beginning of the exemplary portion 402. For instance, the penetration of the work implement 202 may be set to 50 percent of the width 'W' of the work implement 202. That is, the work implement 202 may be penetrated to half width into the terrain profile 104. In an embodiment, adjusting the penetration of the work implement 202 into the terrain profile 104 may be based on type of constituent material in the first segment 'S1'. For instance, the predetermined depth 'X' from the terrain profile 104 may be set to 30 percent when constituent material in first segment 'S1' is hard. Besides operational commands for adjusting penetration of the work implement 202, operational commands concerning movement of the machine 102 may also be communicated by the controller 310.

Additionally, based on the inclination of the terrain profile 104 of first segment 'S1', operational commands for controlling movement of the machine 102 may also be communicated. That is, the operational commands may also include setting speed of the machine 102 travelling along the inclined terrain profile in the first segment 'S1'. Accordingly, the controller 310 controls the operation of the machine 102 until the machine 102 reaches the second node 418, to obtain the excavated terrain profile 424 (see FIG. 5). As such, the machine 102 is operated autonomously by the controller 310.

FIG. 5 illustrates a schematic diagram of operation of the machine 102 along the excavation path of the first segment 'S1', in accordance with an aspect of the current disclosure. Subsequent to determining the second node 418, the controller 310 is configured to define a third node 502 at a point of intersection of a flat portion of the target terrain profile 408 and an inclined portion of the target terrain profile 408. In cases where such point of intersection does not exist, the third node 502 is defined at a point on the terrain profile 104, such that the third node 502 is not lower than the second node 418. In cases where both such methods of defining the third node 502 is not applicable, the third node 502 is defined at a point on the target terrain profile 408 having an elevation equal to elevation of the second node 418. Since the target terrain profile 408 generated for the exemplary portion 402 in FIG. 4 or FIG. 5 includes a point of intersection of the flat portion and the inclined portion, the controller 310 defines the third node 502 at such point, as shown in FIG. 5. A second line segment 504 extending between the second node 418 and the third node 502 indicates the excavation path for the machine in the second segment 'S2'.

In operation, the machine 102 moves material present along the excavation path and travels until a front end of the tracks 210 of the machine 102 reaches the third node 502, thereby obtaining the excavated terrain profile 424. Upon reaching the third node 502, the material is dumped into pit 506 to form a first dump 508. Thereafter, the operational commands received from the controller 310 may cause the machine 102 to retrace the excavation path in a reverse direction until the machine 102 reaches the beginning of the exemplary portion 402 of the worksite 100.

During the excavation operation of the machine 102 along the excavation path, the perception unit 302 captures the excavated terrain profile 424 and generates inputs indicative of the excavated terrain profile 424. The receiving unit 304 of the system 110 receives real-time inputs indicative of the excavated terrain profile 424. Owing to the communication between the controller 310 and the receiving unit 304, the controller 310 determines whether the excavated terrain profile 424 matches with the target terrain profile 408. In an example, the matching of the excavated terrain profile 424 and the target terrain profile 408 may be performed by comparing two-dimensional diagram of the excavated terrain profile 424 with that of the target terrain profile 408. When the excavated terrain profile 424 is not matching with the target terrain profile 408, the controller 310 is configured to generate additional excavation plans 510, 512, and 514 (as shown in FIG. 5) and operate the machine 102 to execute the additional excavation plans 510, 512, and 514. As such, nodes of each of the excavation plan 510, 512, and 514 vary from their previous defined points.

Due to the first dump 508, terrain of the second segment 'S2' extends by a distance corresponding to a width of the first dump 508. The controller 310 then defines the third node 502 at a point on the excavated terrain profile 424, such that the third node 502 is located at a maximum travel point which is not lower than the second node 418. As the machine 102 executes each of the excavation plans 510, 512, and 514 along respective excavation paths, the first node 416 and the third node 502 get re-defined. As such, the machine 102 travels longer distance until it reaches the third node 502, thereby filing the pit 506 with additional dump of material, such as a second dump 518, a third dump 520, and so on, until the pit 506 is filled and the machine 102 encounters a wall 524. It will be understood that the material dumped into the pit 506 may be loose soil, and movement of the machine 102 over such loose soil may cause compactness of the soil in the pit 506. Any decrease in level of the material in the pit 506 due to movement of the machine 102 thereon may be compensated by dumping additional material into the pit 506 to achieve a flat terrain.

In case material is left over in segment-1 as overburden even after filling the pit 506, the controller 310 operates the machine 102 by generating further excavation plans. The machine 102 moves material from segment-1 and over segment-2 until the wall 524 is encountered. Since the machine 102 has reached a maximum travel path, the controller 310 controls the machine 102 to dump the material at the wall 524, where such dumping forms a heap 526. By executing such operation repeatedly, the machine 102 may be able to back stack multiple heaps as shown in FIG. 5. Upon completing a first layer 528 of back stacked material, the controller 310 defines additional nodes to generate additional excavation paths for the machine 102 so that additional layers of stacking can be formed on the first layer 528 until the target terrain profile 408 is achieved. In an aspect of the current disclosure, the controller 310 may define a fourth node 530, after the third node 502, at a point on the target terrain profile 408 that is higher than a previous layer, as shown in FIG. 5. Further, a third line segment 532 may be plotted to extend from the fourth node 530 horizontally and meet the target terrain profile 408 on an opposite side. A point of intersection of the third line segment 532 and the target terrain profile 408 at a side opposite that of the third node 502 may be defined as a fifth node 534. The third line segment 532 may define the excavation path for the machine 102 to stack additional layers of material over the first layer 528. Similarly, the controller 310 may define additional nodes in the excavation plan 414 until the target terrain profile 408 is achieved.

Figure 6A:
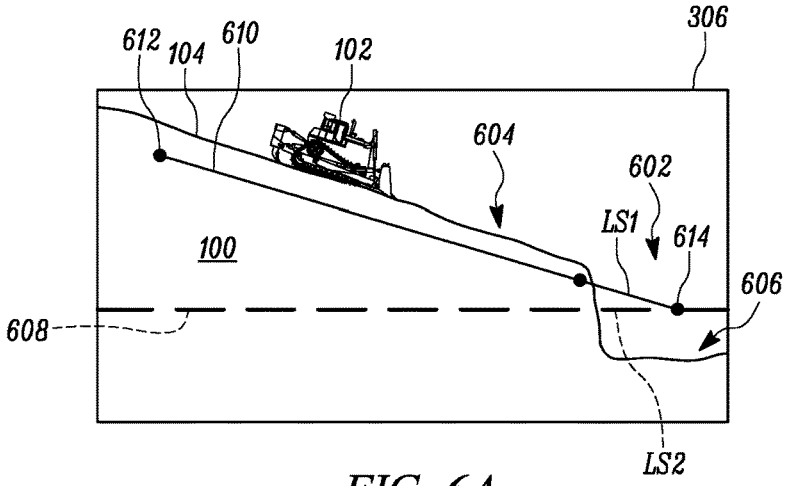
FIGS. 6A, 6B and 6C are schematic diagrams of multiple exemplary portions of the worksite and excavation plans generated therefor, according to another aspect of the current disclosure.
Figure 6B:
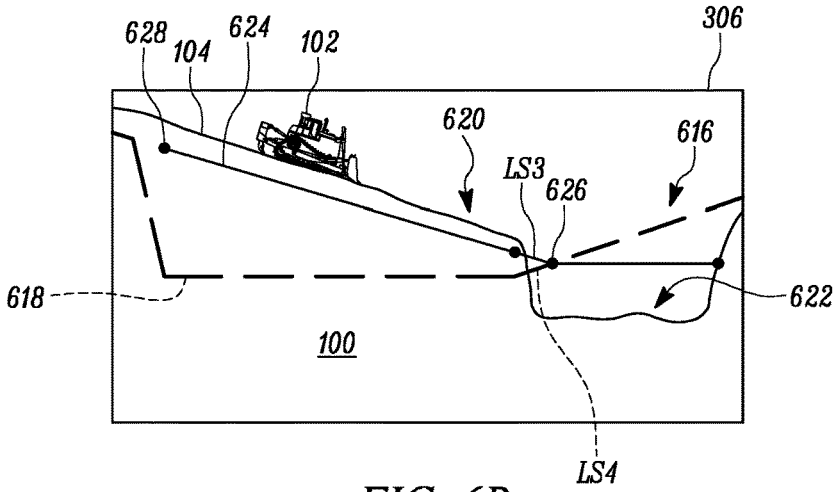
Figure 6C:
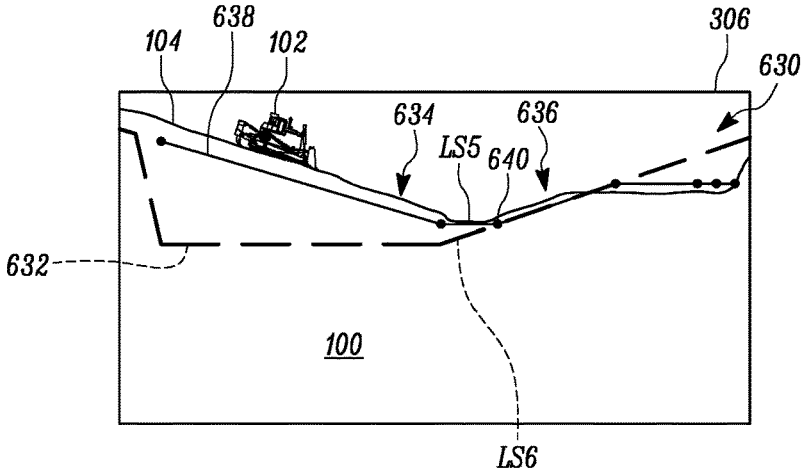

FIGS. 6A, 6B and 6C illustrate schematic diagrams of multiple exemplary portions of the worksite 100 and excavation plans generated therefor, according to another aspect of the current disclosure. In an example, the worksite 100 may be a coal mining site, which may include voids and crests. In the coal mining site, voids may be formed to mine coal and multiple crests are formed around the voids or at the worksite 100 as the material removed to form the voids may be piled to form the crests. After mining, the voids may be filled with the material. Hence, the machine 102, such as the loader, may be disposed at the worksite 100 for autonomously filling the voids and for removing material from the worksite 100. As such, the multiple exemplary portions illustrated hereinbelow may be associated with a cut zone and a fill zone, and excavation plans are generated based on the terrain profile of the cut zone and the fill zone.

Referring to FIG. 6A, a schematic two-dimensional diagram of a first exemplary portion 602 of the worksite 100 is displayed in the user interface 306. The controller 310 may generate a first two-dimensional diagram of the terrain profile 104 of the first exemplary portion 602 based on captured images or captured frames of the terrain profile 104 by the perception unit 302. The terrain profile 104 of the first exemplary portion 602, according to an aspect of the current disclosure, may include an inclined terrain profile 604 and a void 606 as shown. The controller 310 may further generate a second two-dimensional diagram of a target terrain profile 608. The controller 310 may further superimpose the first two-dimensional diagram and the second two-dimensional diagram and generate an excavation plan 610 based on the target terrain profile 608 and the operator's desire. The generation of the excavation plan 610 and the operator's desire are discussed in detail hereinbelow with reference to FIG. 6B. The excavation plan 610 of the first exemplary portion 602 may be schematically represented by a current line segment LS1, which is defined along the inclined terrain profile 604 at the predetermined depth 'X', as described in FIG. 4, and extend from a node 612 towards the void 606. The node 612, otherwise referred to as start point for the excavation plan 610, may be defined as illustrated in FIG. 4. The second two-dimensional diagram of the target terrain profile 608 may be schematically represented by a target line segment LS2, which is horizontal to a coal layer (not shown) in the worksite 100. In the illustrated aspect of the current disclosure, amount of material required to fill a volumetric space of the void 606 may be greater than amount of material available in the inclined terrain profile segment of the first exemplary portion 602, i.e., the amount of material available in the cut zone of the first exemplary portion 602. As such, the current line segment LS1 and the target line segment LS2 may intersect at a point 614, which is otherwise referred to as 'the pivot point 614'.

Referring to FIG. 6B, a schematic two-dimensional diagram of a second exemplary portion 616 of the worksite 100 is displayed in the user interface 306. As described in FIG. 6A, the controller 310 may generate a first two-dimensional diagram of the terrain profile 104 of the second exemplary portion 616 and a second two-dimensional diagram of a target terrain profile 618. The terrain profile 104 of the second exemplary portion 616, according to an aspect of the current disclosure, may include an inclined terrain profile 620 and a void 622 as shown. The controller 310 may further superimpose the first two-dimensional diagram and the second two-dimensional diagram and generate an excavation plan 624 based on the target terrain profile 618 and the operator's desire. In the illustrated aspect of the current disclosure, amount of material required to fill a volumetric space of the void 622 may be less than amount of material available in the inclined terrain profile segment of the second exemplary portion 616, i.e., the amount of material available in the cut zone of the second exemplary portion 616. As such, a current line segment LS3 representing the excavation plan 624 and a target line segment LS4 representing the second two-dimensional diagram may intersect at a point 626, which is otherwise referred to as 'the pivot point 626'. Thus, a point of intersection between the excavation plan 624 and the target terrain profile 618 may be defined as the pivot point 626. In the illustrated aspect, the current line segment LS3 may be defined along the inclined terrain profile 620 at the predetermined depth 'X' and extend from a node 628 towards the void 622. Further, the current line segment LS3 may extent horizontally from the pivot point 626 towards side wall of the void 622. The target line segment LS4 may extend horizontally from the start of the second exemplary portion 616 and extend upward from side wall of the void 622 at a predefined slope. The predefined slop may be set based on the terrain profile 104 of the second exemplary portion 616 and the operational characteristics of the machine 102.

For the illustration purpose of the current disclosure, an area of the second exemplary portion 616 defined at the left of the pivot point 626 is referred to as the cut zone and an area of the second exemplary portion 616 at the right of the pivot point 626 is referred to as the fill zone. Thus, the pivot point 626 may be configured to define the cut zone and the fill zone at the worksite 100. The controller 310 may communicates the operational commands to the machine 102 via the communication channel 108 to perform the excavation operations in the cut zone until the material is removed therefrom to achieve the target terrain profile 618. Referring to the first and second exemplary portions 602, 616 described in FIGS. 6A and 6B, respectively, the excavation operations performed by the machine 102 may be otherwise referred to as 'push to edge' operation, as the machine 102 is instructed to push the material from the nodes 612, 628 of the excavation plans 610, 624 till the edge of the inclined terrain profiles 604, 620 or dump the material in the voids 606, 622, respectively. Also, the pivot points 614, 626 defined in the two-dimensional superimposed diagrams of the first exemplary portion 602 and the second exemplary portion 604 may be virtual points as the intersection of the current line segments LS1, LS3 and the target line segments LS2, LS4 occurs in void segments of the first and second exemplary portions 602, 616, respectively.

Referring to FIG. 6B, in the cut zone, the excavation plan 624 may be defined based on elevation of each successive points with respect to the target terrain profile 618. Specifically, the elevation of each successive point in the terrain profile 104 may be determined based on the target terrain profile 618 to be achieved and the operator's desire. The operator's desire may vary based on multiple operating parameters of the machine 102 with which the operator wants to control the machine 102. The operator's desire may also vary based on the operational characteristics of the machine 102. In an example, the multiple operating parameters may include, but not limited to, position and orientation of the machine 102 with respect to the ground surface, speed of the machine 102, and load carrying capacity of the machine 102 at given slope of the inclined terrain profile 620. In the illustrated aspect of the current disclosure, an empirical relation to determine the excavation plan 624 in the cut zone may be: Excavation Plan=max (the target terrain profile, Operator's desire). In other aspects of the current disclosure, the excavation plan 624 may be determined based on various mathematical and/or empirical relations between the terrain profile 104, the target terrain profile 618, and the operational characteristics of the machine 102.

Similarly, in the fill zone, the excavation plan 624 may be defined based on elevation of each successive point with respect to the target terrain profile 618. Specifically, the elevation of each successive point may be determined based on the target terrain profile 618 to be achieved and the operator's desire. In the illustrated aspect of the current disclosure, an empirical relation to determine the excavation plan 624 in the fill zone may be: Excavation Plan=min (target terrain profile, Operator's desire). In other aspects of the current disclosure, the excavation plan 624 may be determined based on various mathematical and/or empirical relations between the terrain profile 104, the target terrain profile 618, and the operational characteristics of the machine 102. Thus, the controller 310 may be configured to generate the excavation plan 624 in the cut zone and the fill zone based on the target terrain profile 618 and the operator's desire. The excavation plan 610 for the first exemplary portion 602 may also be generated based on the empirical relations as described above.

The excavation plan 624 may also be determined based on certain criteria that design of the excavation plan 624 have to be limited in such a way that the excavation plan 624 does not go below the target terrain profile 618 in the cut zone and does not go above the target terrain profile 618 in the fill zone. Also, as the material is required to be removed from the cut zone, the work implement 202 of the machine 102 is adjusted in such a way that the work implement 202 does not go below the target terrain profile, and hence any potential damage to coal layer may be avoided. Whereas, in the fill zone, as the material required to be dumped, the machine 102 may pile the material in dump locations of the fill zone on a slope not exceeding the predefined slope of the target terrain profile 618. Such that the machine 102 and other earthmoving equipment may climb and modify the piled material to achieve the target terrain profile 618.

Referring to FIG. 6C, a schematic two-dimensional diagram of a third exemplary portion 630 of the worksite 100 is displayed in the user interface 306. As described in FIGS. 6A and 6B, the controller 310 may generate a first two-dimensional diagram of the terrain profile 104 of the third exemplary portion 630 and a second two-dimensional diagram of a target terrain profile 632. The terrain profile 104 of the third exemplary portion 630, according to an aspect of the current disclosure, may include an inclined terrain profile 634 and an uphill terrain profile 636 as shown. The uphill terrain profile 636 may be formed based on the excavation operation, otherwise referred as 'back-stacking' operation, described in FIG. 5. The controller 310 may further superimpose the first two-dimensional diagram and the second two-dimensional diagram and generate an excavation plan 638 based on the target terrain profile 632 and the operator's desire. A current line segment LS5 representing the excavation plan 638 and a target line segment LS6 representing the second two-dimensional diagram may intersect at a point 640, which is otherwise referred to as 'the pivot point 640'. In the illustrated aspect, the current line segment LS5 may be defined along the inclined terrain profile 634 and the uphill terrain profile 636 and the target line segment LS6 may be defined as illustrated in FIG. 6B. The pivot point 640 defined in the two-dimensional superimposed diagram of the third exemplary portion 630 may be a realistic point as the intersection of the current line segment LS5 and the target line segments LS6 occurs at the junction of the inclined terrain profile 634 and the uphill terrain profile 636. The excavation plan 638 for the third exemplary portion 630 may also be generated based on the empirical relations as described in FIG. 6B. In an aspect, as the pivot point 640 is a realist point, the pivot point 640 may also be considered as an input for generating the excavation plan 638.

Figure 7:
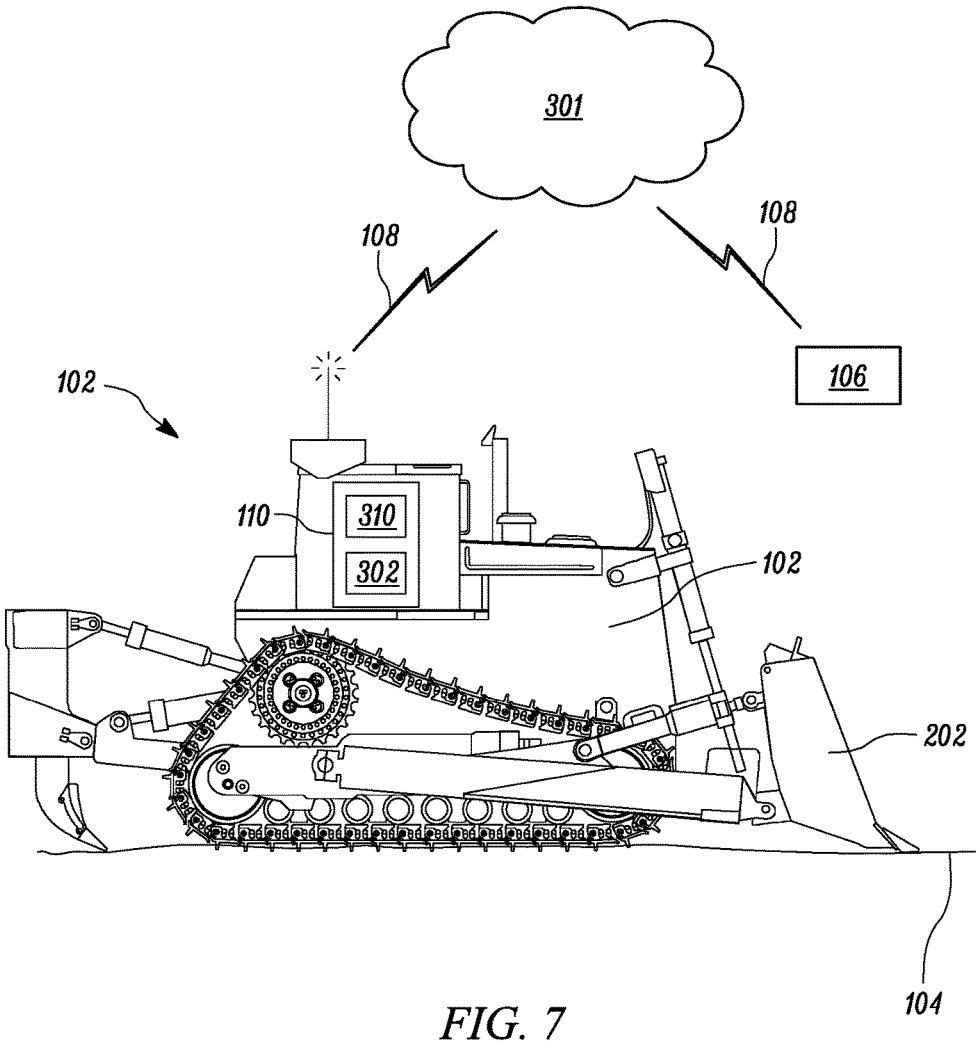
FIG. 7 is a schematic block diagram of the machine equipped with the control system, according to another aspect of the current disclosure.

FIG. 7 illustrates a schematic block diagram of the system 110 disposed within the machine 102, in accordance with another aspect of the current disclosure. The system 110 is provided as an integral part of the machine 102 as illustrated in FIG. 7.

The system 110 of FIG. 7 includes the controller 310. The controller 310 is configured to receive the first input 'I-1' indicative of the terrain profile 104 of the worksite 100, a second input 'I-2' indicative of the target terrain profile 408 for the worksite 100, and the third input 'I-3' indicative of characteristics of the machine 100. In one embodiment, the controller 310 may be communicable coupled to the perception unit 302 to receive the first input 'I-1'. The perception unit 302 may be embodied as a camera and may be mounted on the machine 102 to capture the terrain profile 104 of the worksite 100. In another embodiment, the perception unit 302 may be embodied as a device located remotely with respect to the machine and capable of capturing the terrain profile 104 of the worksite 100. In both these embodiment, the perception unit 302 is configured to generate the first input 'I-1' indicative of the terrain profile 104.

The second input 'I-2' may be received from the operator station 106 through the communication channel 108 and the network 301. Further, characteristics of the machine 102 may be stored in a memory (not shown) of the controller 310. As such, the controller 310 may receive or retrieve the characteristics of the machine 102 from the memory.

The controller 310 is further configured to generate the excavation plan 414 based on the first input 'I-1', the second input 'I-2', and the third input 'I-3'. Based on the generated excavation plan 414, the controller 310 is configured to adjust the work implement 202 and control movement of the machine 102 along the terrain profile 104 to obtain the excavated terrain profile 424. Since the perception unit 302 captures the excavated terrain profile 424 upon execution of each excavation plan 414, the perception unit 302 generates inputs indicative of the excavated terrain profile 424 as well. Owing to the connection between the controller 310 and the perception unit 302, the controller 310 receives real-time inputs, from the perception unit 302, indicative of the excavated terrain profile 424.

On receipt of such real-time inputs from the perception unit 302, the controller 310 is configured to determine whether the excavated terrain profile 424 matched with the target terrain profile 408. Further, the controller 310 generates operational commands to operate the machine 102 based on the inputs indicative of the excavated terrain profile 424, the second input 'I-2', the third input 'I-3', and an extent of match between the excavated terrain profile 424 and the target terrain profile 408.

In one embodiment, the machine 102 equipped with the system 110 may be considered as a master machine and multiple other machines operating simultaneously at the worksite 100 may be controlled by the system 110 of the master machine. For example, the master machine may generate excavation plans for other machines operating at the worksite 100. Since the machine 102 is in communication with the operator station 106, the operator at the operator station 106 may be notified regarding extent of completion of the excavation plans by each machine operating at the worksite 100.

INDUSTRIAL APPLICABILITY

Figure 8:
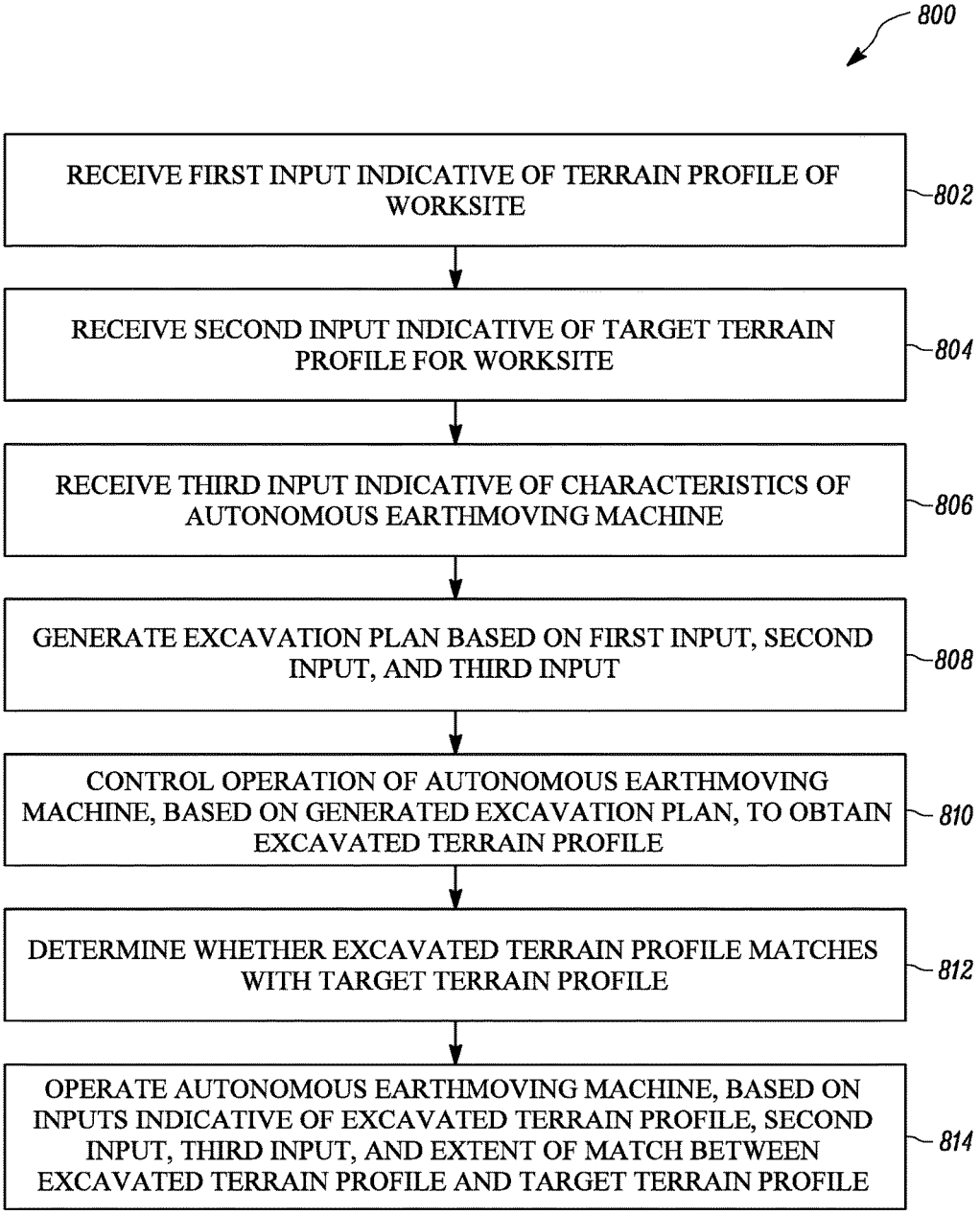
FIG. 8 is a flow chart of a method of controlling the earthmoving machine operating at the worksite, according to an aspect of the current disclosure.

The current disclosure relates to the system 110 and a method 800 for controlling the machine 102 operating at the worksite 100. FIG. 8 illustrates a flow chart of the method 800 of controlling the machine 102, in accordance with an aspect of the current disclosure. The steps in which the method 800 is described are not intended to be construed as a limitation, and the steps can be combined in any order to implement the method 800. Further, the method 800 may be implemented using any suitable software, hardware, or a combination of software and hardware, such that the software, the hardware, or the combination thereof can perform the steps of the method 800 readily and on a real-time basis. In an aspect of the current disclosure, the controller 310 can be configured to perform the steps of the method 800.

Various steps of the method 800 are described in conjunction with FIG. 1 to FIG. 5 of the current disclosure. As illustrated, at step 802, the method 800 includes receiving the first input 'I-1' indicative of the terrain profile 104 of the worksite 100. In an aspect, the method 800 may include capturing, by the perception unit 302, the terrain profile 104 of the worksite 100 and generating the first input 'I-1' based on the captured terrain profile 104. The generated first input 'I-1' may be received by the receiving unit 304 on a real-time basis. Since the first input 'I-1' is automatically and continuously generated by the perception unit 302, occurrence of errors in the first input 'I-1' may be overcome.

At step 804, the method 800 includes receiving the second input 'I-2' indicative of the target terrain profile 408 for the worksite 100. The target terrain profile 408 may be indicative of a desired terrain at the worksite 100. Data pertaining to the target terrain profile 408 may be fed into the system 110. At step 806, the method 800 includes receiving the third input 'I-3' indicative of characteristics of the machine 102. In one example, the characteristics of the machine 102 may include, but not limited to, the width 'W' of the work implement 202 of the machine 102, length of the work implement 202 of the machine 102, width of the machine 102.

At step 808, the method 800 includes generating the excavation plan 414 based on the first input 'I-1', the second input 'I-2', and the third input 'I-3'. The excavation plan 414 includes multiple nodes and multiple segments, where each segment connects two consecutive nodes. Each segment indicates the excavation path for the machine 102 executing the excavation plan 414. Since the generated excavation plan 414 is based on automatically gathered inputs, manual consideration of parameters for the purpose of generating the excavation plan 414 is eliminated.

At step 810, the method 800 includes controlling the operation of the machine 102 based on the excavation plan 414 to obtain the excavated terrain profile 424. In one embodiment, the method 800 may include generating operational commands, by the controller 310, and communicating the generated operational commands, via the communication channel 108, to the machine 102. In one example, the operational commands may include adjusting penetration of the work implement 202 of the machine 102 into the terrain profile 104. In another example, the operational command may also include setting of speed of movement of the machine 102 along the excavation path.

At step 812, the method 800 includes determining whether the excavated terrain profile 424 matches with the target terrain profile 408. At step 814, the method 800 includes operating the machine 102, based on inputs indicative of the excavated terrain profile 424, the second input 'I-2', the third input 'I-3', and an extent of match between the excavated terrain profile 424 and the target terrain profile 408.

Although not explicitly covered as steps in FIG. 8, the method 800 includes generating the first two-dimensional diagram 404 of the worksite 100 based on the terrain profile 104, generating the second two-dimensional diagram 406 of the worksite 100 based on the target terrain profile 408, and generating the superimposed diagram 410 based on the first two-dimensional diagram 404 and the second two-dimensional diagram 406.

Thus, the system 110 and the method 800 of the current disclosure provide an efficient way to generate excavation plans for earthmoving machines 102 operating at the worksite 100. Additionally, since the excavation plans are generated by the system 110, requirement of large number of workers at the operator station 106 may be avoided, thereby minimizing operational cost of generating excavation plans. Further, efficiency of executing the excavation plan 414 correctly may be increased which was otherwise low in present day planning systems.

What is claimed is:

1. A control system for controlling an earthmoving machine operating at a worksite, the control system comprising:

a receiving unit configured to:

receive a first input including one or more images indicative of a terrain profile of the worksite;

receive a second input indicative of a target terrain profile for the worksite; and receive a third input indicative of characteristics of the earthmoving machine; and a mission planning controller in communication with the receiving unit, the mission planning controller configured to:

generate an excavation plan based on the first input, the second input, and the third input;

control operation of the earthmoving machine, based on the generated excavation plan, to obtain an excavated terrain profile of the worksite, the receiving unit further configured to receive inputs of one or more images indicative of the excavated terrain profile of the worksite;

determine whether the excavated terrain profile matches with the target terrain profile by comparing the inputs of the one or more images indicative of the excavated terrain profile with the second input indicative of the target terrain profile; and operate the earthmoving machine, based on the inputs of the one or more images indicative of the excavated terrain profile, the second input, the third input, and an extent of match between the excavated terrain profile and the target terrain profile.

2. The control system of claim 1, wherein the mission planning controller is configured to generate additional excavation plans when the excavated terrain profile does not match the target terrain profile.

3. The control system of claim 2, wherein the receiving unit is configured to receive real-time inputs indicative of the excavated terrain profile upon execution of each excavation plan of the additional excavation plans.

4. The control system of claim 1, wherein the mission planning controller is configured to:

generate a first two-dimensional diagram of the worksite based on the terrain profile;

generate a second two-dimensional diagram of the worksite based on the target terrain profile; and generate a superimposed diagram based on the first two-dimensional diagram and the second two-dimensional diagram.

5. The control system of claim 1, wherein the excavation plan comprises a plurality of nodes and a plurality of segments, and wherein each segment connecting two consecutive nodes is indicative of an excavation path for the earthmoving machine.

6. The control system of claim 5, wherein the plurality of nodes in the excavation plan comprises:

a first node defined at a beginning of a predefined portion of the worksite and at a predetermined depth from the terrain profile, based on the characteristics of the earthmoving machine and the target terrain profile; and a second node defined at one of:

a point of intersection of the target terrain profile and a locus of the first node tracing a path spaced apart at the predetermined depth along the terrain profile;

a point of intersection of the target terrain profile and an inclined line extending from the first node, wherein the inclined line is associated with a predetermined slope; and an end of the predefined portion of the worksite.

7. The control system of claim 6, wherein the plurality of nodes in the excavation plan comprises a third node defined at one of:

a point of intersection of a flat portion of the target terrain profile and an inclined portion of the target terrain profile;

a point on the terrain profile, such that the third node is not lower than the second node; and a point on the target terrain profile having an elevation equal to elevation of the second node.

8. The control system of claim 7, wherein the mission planning controller is further configured to:

generate an additional excavation plan when the excavated terrain profile does not match the target terrain profile, the additional excavation plan redefining the first node and the third node, wherein the third node for the additional excavation plan is redefined at a point on the excavated terrain profile such that the third node is located at a maximum travel point which is not lower than the second node; and operate the earthmoving machine to execute the additional excavation plan.

9. The control system of claim 1, wherein the excavation plan comprises a pivot point, the pivot point being defined at an intersection of the excavation plan and the target terrain profile, and being configured to define a cut zone and a fill zone at the worksite, and wherein the controller is configured to generate the excavation plan in the cut zone and the fill zone based on the target terrain profile.

10. A method for controlling an earthmoving machine operating at a worksite, the method comprising:

receiving a first input indicative of a terrain profile of the worksite from an aerial perception unit;

receiving a second input indicative of a target terrain profile for the worksite;

receiving a third input indicative of characteristics of the earthmoving machine;

generating an excavation plan based on the first input, the second input, and the third input;

controlling operation of the earthmoving machine, based on the generated excavation plan, to obtain an excavated terrain profile;

receiving inputs indicative of the excavated terrain profile from the aerial perception unit;

determining whether the excavated terrain profile matches with the target terrain profile by comparing the inputs indicative of the excavated terrain profile with the second input indicative of the target terrain profile; and operating the earthmoving machine, based on the inputs indicative of the excavated terrain profile, the second input, the third input, and an extent of match between the excavated terrain profile and the target terrain profile.

11. The method of claim 10 further comprising generating additional excavation plans when the excavated terrain profile does not match the target terrain profile.

12. The method of claim 10 further comprising:

generating a first two-dimensional diagram of the worksite based on the terrain profile;

generating a second two-dimensional diagram of the worksite based on the target terrain profile; and generating a superimposed diagram based on the first two-dimensional diagram and the second two-dimensional diagram.

13. The method of claim 10, wherein the excavation plan comprises a plurality of nodes and a plurality of segments, and wherein each segment connecting two consecutive nodes is indicative of an excavation path for the earthmoving machine.

14. The method of claim 13, wherein the plurality of nodes in the excavation plan comprises:

a first node defined at a beginning of a predefined portion of the worksite and at a predetermined depth from the terrain profile, based on the characteristics of the earthmoving machine and the target terrain profile; and a second node defined at one of:

a point of intersection of the target terrain profile and a locus of the first node tracing a path spaced apart at the predetermined depth along the terrain profile;

a point of intersection of the target terrain profile and an inclined line extending from the first node, wherein the inclines line is associated with a predetermined slope; and an end of the predefined portion of the worksite.

15. The method of claim 14, wherein the plurality of nodes in the excavation plan comprises a third node defined at one of:

a point of intersection of a flat portion of the target terrain profile and an inclined portion of the target terrain profile;

a point on the terrain profile, such that the third node is not lower than the second node; and a point on the target terrain profile having an elevation equal to elevation of the second node.

16. The method of claim 15, further comprising:

generating an additional excavation plan when the excavated terrain profile does not match the target terrain profile, the additional excavation plan redefining the first node and the third node, wherein the third node for the additional excavation plan is redefined at a point on the excavated terrain profile such that the third node is located at a maximum travel point which is not lower than the second node; and operating the earthmoving machine to execute the additional excavation plan.

17. The method of claim 10 comprising generating the excavation plan in a cut zone and a fill zone of the worksite based on the target terrain profile, wherein the cut zone and the fill zone are defined by a pivot point, the pivot point being defined at an intersection of the excavation plan and the target terrain profile.

18. An earthmoving machine comprising:

a work implement for engaging a ground surface of a worksite; and a control system for operating the earthmoving machine, the control system comprising:

a mission planning controller configured to:

receive a first input indicative of a terrain profile of the worksite;

receive a second input indicative of a target terrain profile for the worksite;

receive a third input indicative of characteristics of the earthmoving machine;

generate an excavation plan based on the first input, the second input, and the third input, wherein the excavation plan comprises a plurality of nodes and a plurality of segments, and wherein each segment connecting two consecutive nodes is indicative of an excavation path for the earthmoving machine;

adjust the work implement, based on the generated excavation plan, to obtain an excavated terrain profile;

determine whether the excavated terrain profile matches with the target terrain profile;

operate the earthmoving machine, based on inputs indicative of the excavated terrain profile, the second input, the third input, and an extent of match between the excavated terrain profile and the target terrain profile; and when the excavated terrain profile does not match the target terrain profile, generate an additional excavation plan redefining one or more of the plurality of nodes and operate the earthmoving machine to execute the additional excavation plan.

19. The earthmoving machine of claim 18, wherein the plurality of nodes comprises:

a first node defined at a beginning of a predefined portion of the worksite and at a predetermined depth from the terrain profile, based on the characteristics of the earthmoving machine and the target terrain profile; and a second node defined at one of:

a point of intersection of the target terrain profile and a locus of the first node tracing a path spaced apart at the predetermined distance along the terrain profile;

a point of intersection of the target terrain profile and an inclined line extending from the first node, wherein the inclines line is associated with a predetermined slope; and an end of the predefined portion of the worksite.

20. The earthmoving machine of claim 18, wherein the mission planning controller is in communication with a perception unit and is configured to receive real-time inputs indicative of the excavated terrain profile upon execution of each additional excavation plan.

* * * * *